US010565968B1

(12) United States Patent
Miyajima

(10) Patent No.: US 10,565,968 B1
(45) Date of Patent: Feb. 18, 2020

(54) SNARE WIRE ATTACHMENT STRUCTURE AND SNARE DRUM

(71) Applicant: HOSHINO GAKKI CO., LTD., Nagoya, Aichi (JP)

(72) Inventor: Hideyuki Miyajima, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 0 days.

(21) Appl. No.: 16/423,119

(22) Filed: May 27, 2019

(30) Foreign Application Priority Data

Feb. 22, 2019 (JP) ..... 2019-030460

(51) Int. Cl.
*G10D 13/02* (2020.01)

(52) U.S. Cl.
CPC ..... *G10D 13/025* (2013.01); *G10D 13/027* (2013.01); *G10D 13/028* (2013.01)

(58) Field of Classification Search
CPC ... G10D 13/025; G10D 13/027; G10D 13/028
See application file for complete search history.

(56) References Cited

U.S. PATENT DOCUMENTS

| | | | | |
|---|---|---|---|---|
| 3,113,481 | A | 12/1963 | Thompson | |
| 3,981,220 | A | 9/1976 | Clark | |
| 4,138,920 | A | 2/1979 | Meador | |
| 7,223,910 | B2 * | 5/2007 | Shimada | G10D 13/025 84/415 |
| 7,741,550 | B2 | 6/2010 | Miyajima | |
| 8,193,435 | B1 | 6/2012 | Lombardi et al. | |

FOREIGN PATENT DOCUMENTS

JP S60-163499 U 10/1985

* cited by examiner

*Primary Examiner* — Kimberly R Lockett

(57) ABSTRACT

A snare wire is attached to a snare drum using a snare frame. A string made of flexible material is employed as a coupling member for coupling the snare frame to the snare drum. In the state in which the snare wire is attached to the snare drum by means of the snare frame, frame end sections of the snare wire are each arranged outward with respect to the outer peripheral edge of the back-surface head.

10 Claims, 8 Drawing Sheets

SNARE WIRE ATTACHMENT STRUCTURE AND SNARE DRUM

BACKGROUND

1. Field

The present invention relates to a snare wire attachment structure for attaching a snare wire to a snare drum using a snare frame and a snare drum.

2. Description of Related Art

A snare drum includes a cylindrical shell, a pair of drum heads, a snare wire, and a strainer. The drum heads, together with corresponding hoops, are mounted on the upper and lower opening ends of the shell. The snare wire is attached to the snare drum in a manner contacting the back-surface head. The strainer is fixed to the outer peripheral surface of the shell at such a position as to facilitate manipulation by the player.

The player manipulates the strainer to switch the position of the snare wire selectively to ON position and OFF position. The snare wire contacts the back-surface head when at ON position and is spaced from the back-surface head when at OFF position. To play the snare drum, the player switches the position of the snare wire to ON position and, in this state, strikes the striking-surface head, which is the upper one of the drum heads. This adds the vibration sound of the snare wire to the vibration sound of the striking-surface head and that of the back-surface head, thus producing resonance of the characteristic sound of the snare drum.

The snare wire is configured by a snare portion configured by multiple wires and a pair of end plates. The end plates are located on the opposite ends of the snare portion. Depending on the manner in which the snare portion contacts the back-surface head, the snare wire may be classified as an inside-surface hitting snare wire or a full-surface hitting snare wire. The full length of the inside-surface hitting snare wire is smaller than the diameter of the back-surface head. Therefore, the inside-surface hitting snare wire is attached to the snare drum with the snare portion and the opposite end plates both held in contact with the back-surface head. In contrast, the full length of the full-surface hitting snare wire is greater than the diameter of the back-surface head. Therefore, the full-surface hitting snare wire is attached to the snare drum with the opposite end plates exposed outward with respect to the outer peripheral edge of the back-surface head and with only the snare portion held in contact with the back-surface head.

The snare wire is attached to the snare drum typically using a belt or string. Specifically, the belt or string is hooked to the opposite end plates of the snare wire. Using the belt or string, one of the end sections of the snare wire is coupled to a holder located in a lower section of the strainer. The other end section of the snare wire is coupled, at a position opposite to the strainer, to a holder of a holding tool located on the outer peripheral surface of the shell. The player, while playing the snare drum, manipulates the strainer to pull and raise the snare wire to ON position by means of the belt or string. In this manner, tensile force is applied to the snare wire and, correspondingly, the position of the snare wire is switched from OFF position to ON position.

However, in the above-described snare wire attachment structure, the tensile force of the snare wire and the amount by which the snare portion contacts the back-surface head cannot be adjusted separately. To solve this problem, a snare wire attachment structure that uses a snare frame to attach a snare wire to a snare drum has been proposed. For example, U.S. Pat. Nos. 3,113,481, 8,193,435, 3,981,220, and 4,138,920, as well as Japanese Laid-Open Utility Model Publication No. 60-163499 and U.S. Pat. Nos. 7,223,910 and 7,741,550, disclose snare wire attachment structures using snare frames.

Each of the snare frames disclosed in U.S. Pat. Nos. 3,113,481, 8,193,435, 3,981,220, and 4,138,920 is attached to a snare drum using a string with a snare portion and opposite end plates of a snare wire held in contact with the back-surface head. When the string is pulled intensely to increase the amount by which the snare portion contacts the back-surface head, the snare wire attachment structure disclosed in each of the aforementioned documents causes the end plates of the snare wire to bite into the surface of the back-surface head. The end plates of the snare wire thus hamper vibration of the back-surface head, obstructing resonance of the vibration sound of the striking-surface head and that of the back-surface head.

Each of the snare frames disclosed in Japanese Laid-Open Utility Model Publication No. 60-163499 and U.S. Pat. Nos. 7,223,910 and 7,741,550 is attached to a snare drum using a link component instead of a belt or a string. Two link members made of rigid material such as metal are employed. The snare wire attachment structure disclosed in each of the aforementioned documents holds the opposite longitudinal end sections of the snare frame by means of the link members. However, fixing the snare frame in a manner integrated with the snare drum together with the link members, as in this case, promotes the hampering of the vibration of the snare frame and that of the snare wire. As a result, compared to the attachment structure using a belt or a string, the snare wire attachment structure using a link component decreases resonance of the vibration sound of the snare wire. As has been described, the conventional snare frames have structural problems that hamper resonance of the characteristic sound of a snare drum.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a snare wire attachment structure for attaching a snare wire to a snare drum using a snare frame is provided. The snare drum includes a cylindrical shell, a pair of drum heads, and a coupling member. The drum heads are mounted on the upper and lower opening ends of the shell. The coupling member couples the snare frame to the snare drum. The snare wire includes a snare portion configured by a plurality of wires and a pair of end plates. The end plates are located on the opposite ends of the snare portion. The snare frame includes a frame body portion and a pair of frame end sections. The frame body portion extends in the longitudinal direction of the snare wire. The frame end sections are located on the opposite ends of the frame body portion and the end plates of the snare wire are fixed to the corresponding frame end sections. The coupling member is made of flexible material. In the snare wire attachment structure, in the state in which the snare wire is attached to the snare drum by means of the snare frame, the two frame end sections are each disposed outward with respect to the outer peripheral edge of the corresponding drum head.

In another general aspect, a snare drum that includes a cylindrical shell, a pair of drum heads, a snare wire, a snare frame, and a coupling member is provided. The drum heads are mounted on the upper and lower opening ends of the shell. The snare wire is attached to the shell in a manner contacting the one of the drum heads mounted on the lower opening end of the shell. The snare frame is used to attach the snare wire to the shell. The coupling member couples the snare frame to the shell. The snare wire includes a snare portion configured by a plurality of wires and a pair of end plates. The end plates are located on the opposite ends of the snare portion. The snare frame includes a frame body portion and a pair of frame end sections. The frame body portion extends in the longitudinal direction of the snare wire. The frame end sections are located on the opposite ends of the frame body portion and the end plates of the snare wire are fixed to the corresponding frame end sections. The coupling member is made of flexible material. In the snare drum, in the state in which the snare wire is attached to the shell by means of the snare frame, the frame end sections are each arranged outward with respect to the outer peripheral edge of the corresponding drum head.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An embodiment of a snare wire attachment structure according to the present invention will now be described with reference to FIGS. 1 to 9.

Figure 1:
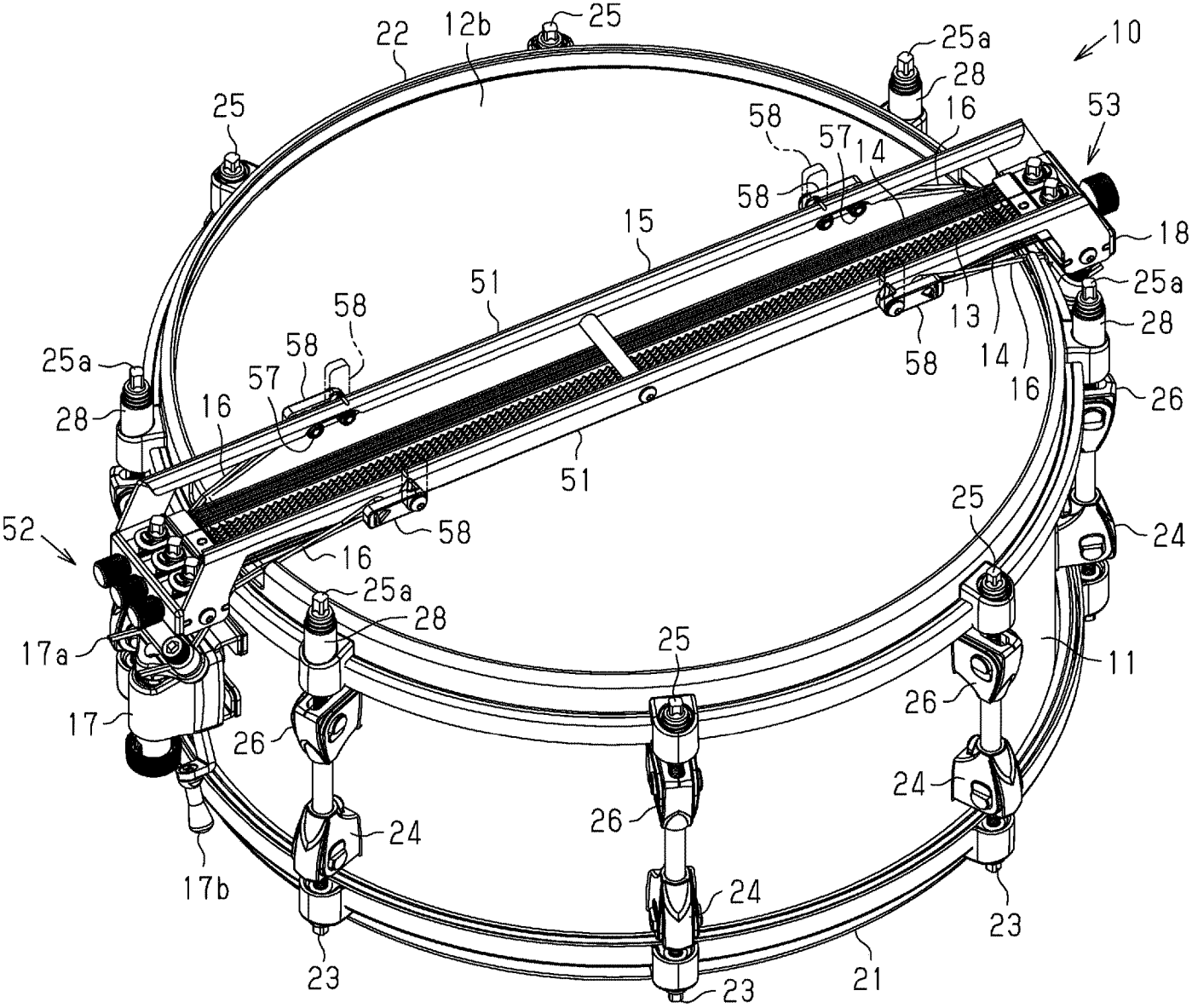
FIG. 1 is a perspective view showing a snare drum with a snare frame according to the present invention attached to the snare drum.
Figure 2:
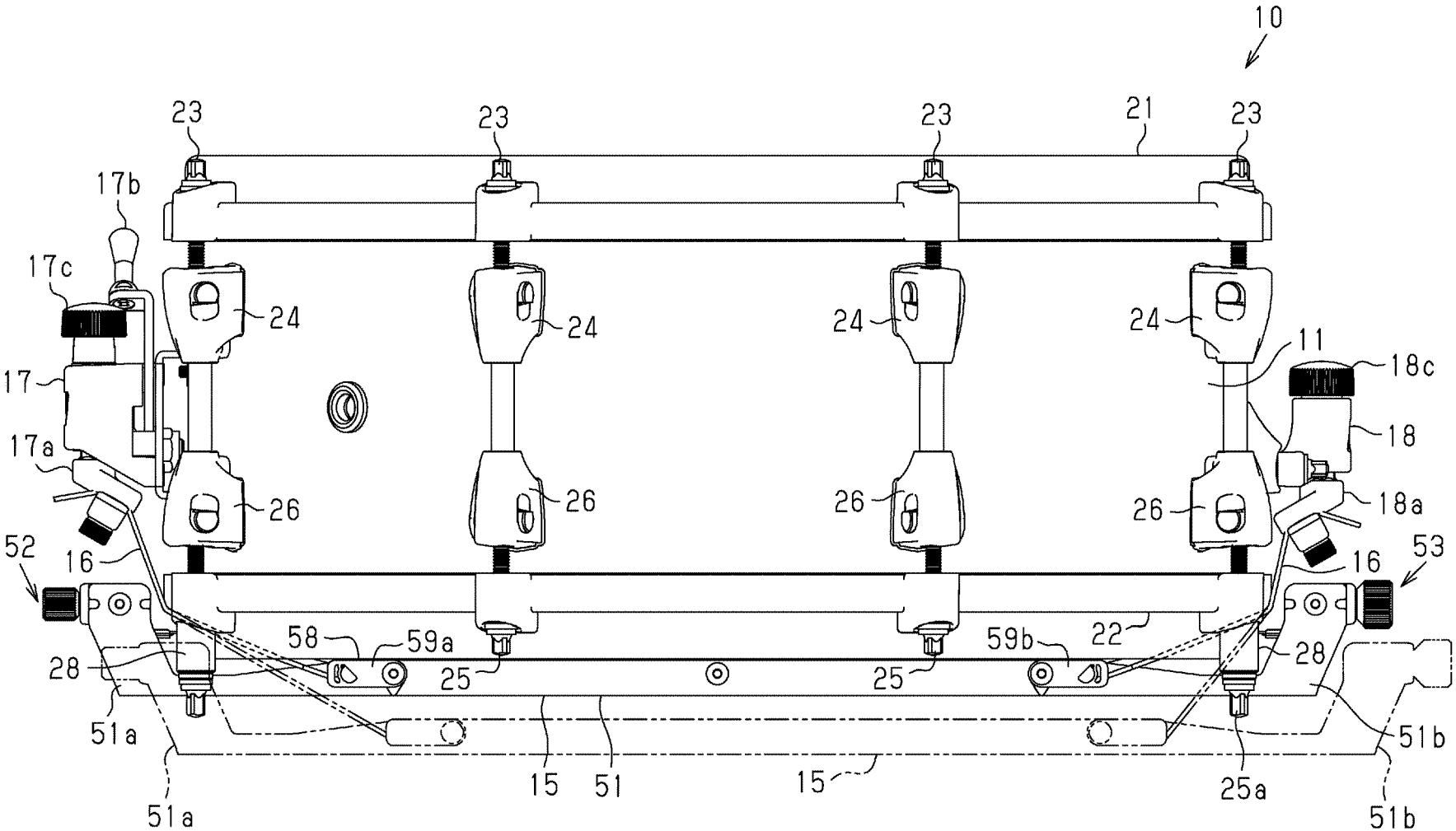
FIG. 2 is a side view showing the snare drum with the snare frame attached to the snare drum.
Figure 3:
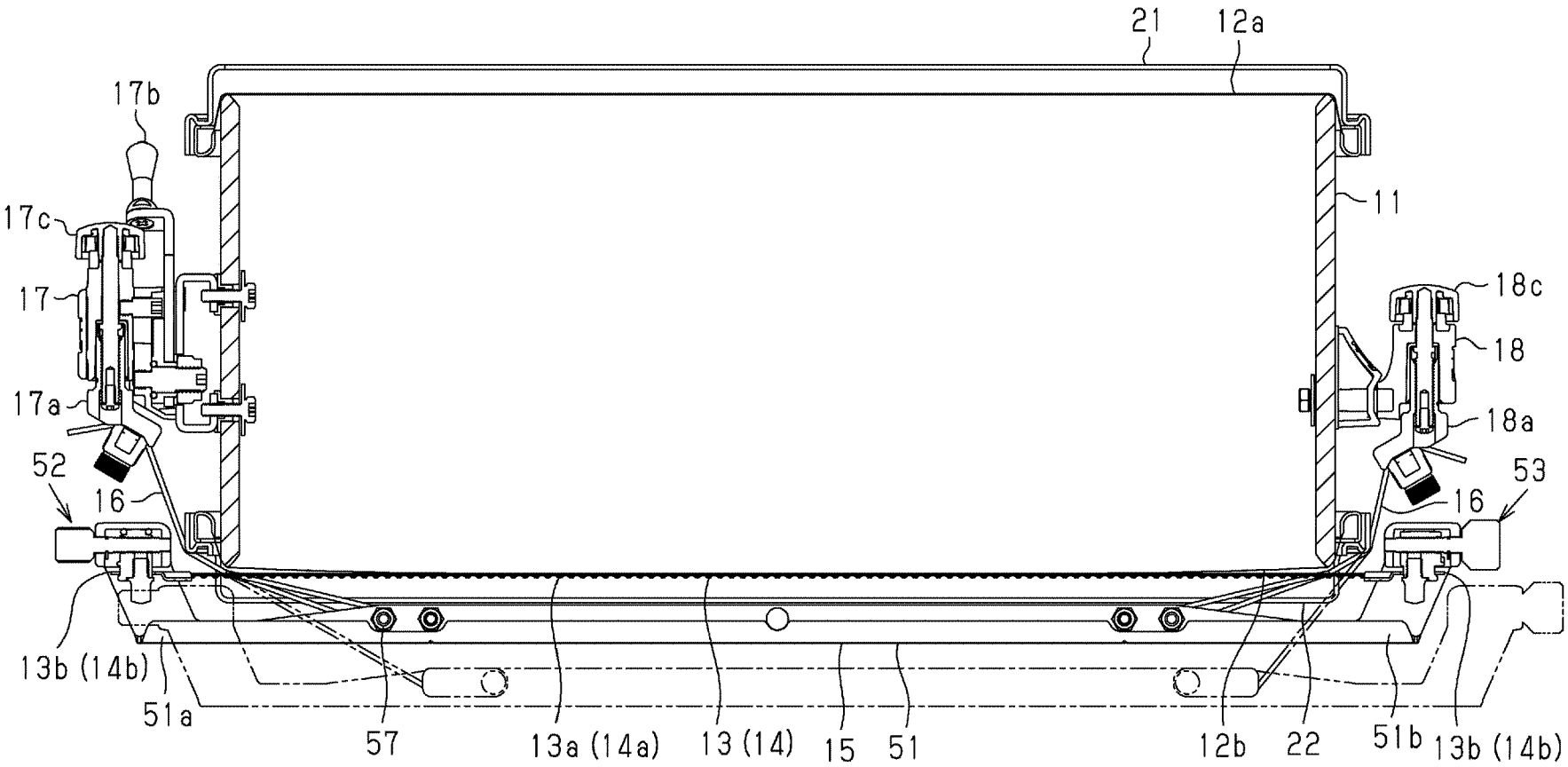
FIG. 3 is a cross-sectional view showing the snare drum with the snare frame attached to the snare drum.

As shown in FIGS. 1 to 3, a snare drum 10 includes a cylindrical shell 11, a pair of drum heads, two types of snare wires 13, 14, a snare frame 15, four strings 16 each serving as a coupling member, a strainer 17, and a holding tool 18. The snare wires 13, 14 are attached to the snare drum 10 using the snare frame 15. One of the types of the snare wires 13, 14 is a coil type and the other a straight type. Through the snare frame 15, a single coil-type snare wire and two straight-type snare wires are attached to the snare drum 10.

A drum head is mounted on the upper opening end of the shell 11, together with an upper hoop 21, and thus functions as a striking-surface head 12*a*. Another drum head is mounted on the lower opening end of the shell 11, together with a lower hoop 22, and thus functions as a back-surface head 12*b*. FIG. 1 shows the snare drum 10 with the back-surface head 12*b* facing upward. FIGS. 2 and 3 each show the snare drum 10 with the back-surface head 12*b* facing downward.

The snare drum 10 includes eight first tension bolts 23 and eight first lugs 24. The first tension bolts 23 fix the upper hoop 21 and the striking-surface head 12*a* to the upper opening end of the shell 11. The first tension bolts 23 are fastened to the corresponding first lugs 24. The snare drum 10 also includes eight second tension bolts 25 and eight second lugs 26. The second tension bolts 25 fix the lower hoop 22 and the back-surface head 12*b* to the lower opening end of the shell 11. The second tension bolts 25 are fastened to the corresponding second lugs 26. The first and second lugs 24, 26 are each fixed to the outer peripheral surface of the shell 11.

Each of the first lugs 24 and the corresponding one of the second lugs 26 are arranged in a manner forming a pair in the up-down direction. The first and second lugs 24, 26 are spaced apart at equal angles about the axis of the shell 11. The first tension bolts 23 are inserted in the threaded holes of the corresponding first lugs 24 and selectively fastened and loosened to change the amount by which the upper hoop 21 is engaged with the shell 11. In this manner, the tensile force of the striking-surface head 12*a* is changed. The second tension bolts 25 are inserted in the threaded holes of the corresponding second lugs 26 and selectively fastened and loosened to change the amount by which the lower hoop 22 is engaged with the shell 11. In this manner, the tensile force of the back-surface head 12*b* is changed. By manipulating the first and second tension bolts 23, 25 in these manners, the sound of the snare drum 10 is adjusted.

Figure 4:
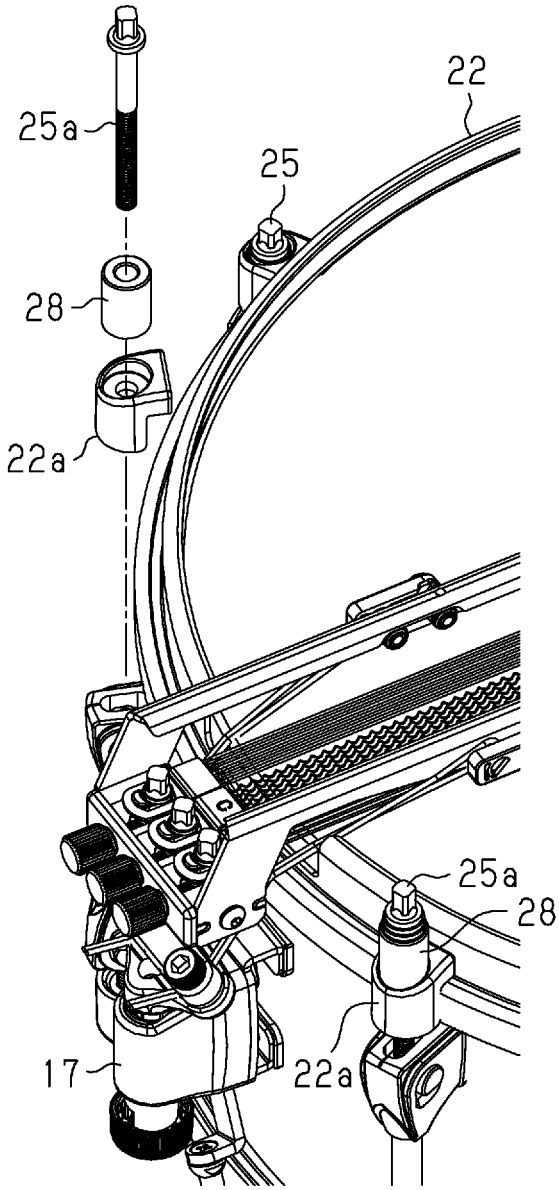
FIG. 4 is an enlarged perspective view showing a section of the snare drum in the vicinity of a leg support.

With reference to FIGS. 1 and 4, the second tension bolts 25 include four elongated tension bolts 25*a* disposed in the vicinities of the opposite end sections of the snare frame 15. The elongated tension bolts 25*a* are longer than the rest of the second tension bolts 25. A cylindrical leg support 28 is mounted on each of the elongated tension bolts 25*a*. Each of the leg supports 28 is fixed to a corresponding bolt fastening portion 22*a* of the lower hoop 22 by means of the elongated tension bolt 25*a*. Each elongated tension bolt 25*a* is longer than the rest of the second tension bolts 25 by the amount corresponding to the section on which the leg support 28 is mounted.

In the state in which the snare wires 13, 14 are attached to the snare drum 10 by means of the snare frame 15, as illustrated in FIG. 2, those of the second tension bolts 25 without a leg support 28 are arranged higher than the upper edge of the snare frame 15. In contrast, the elongated tension bolts 25*a*, on which the leg supports 28 are mounted, project downward with respect to the lower edge of the snare frame 15. If the snare drum 10 is placed on the floor surface with the back-surface head 12*b* facing downward, the distal ends of the elongated tension bolts 25*a* contact the floor surface. In this case, the leg supports 28 each function as a leg portion of the snare drum 10.

With reference to FIGS. 1 to 3, the strainer 17 and the holding tool 18 are each fixed to the outer peripheral surface of the shell 11 at such a position as to avoid the first and second lugs 24, 26. The strainer 17 and the holding tool 18 are arranged at the positions corresponding to the opposite ends of the snare frame 15. The strainer 17 has a lever 17*b*. The lever 17*b* is manipulated to switch the positions of the snare wires 13, 14. The strainer 17 and the holding tool 18 have a holder 17*a* and a holder 18*a*, respectively. The strings 16 are selectively attached to and detached from the corresponding holders 17*a*, 18*a*. The strainer 17 and the holding tool 18 also have a manipulating portion 17*c* and a manipulating portion 18*c*, respectively. The manipulating portions 17*c*, 18*c* are manipulated to adjust the positions of the corresponding holders 17*a*, 18*a* in the up-down direction. The snare frame 15 is coupled to the holder 17*a* of the strainer 17 and the holder 18*a* of the holding tool 18 through the corresponding ones of the four strings 16. Each of the strings 16 is flexible and has high strength. Each string 16 is made of plastic such as polyethylene, polypropylene, polyester, and nylon (trade mark).

Figure 5:
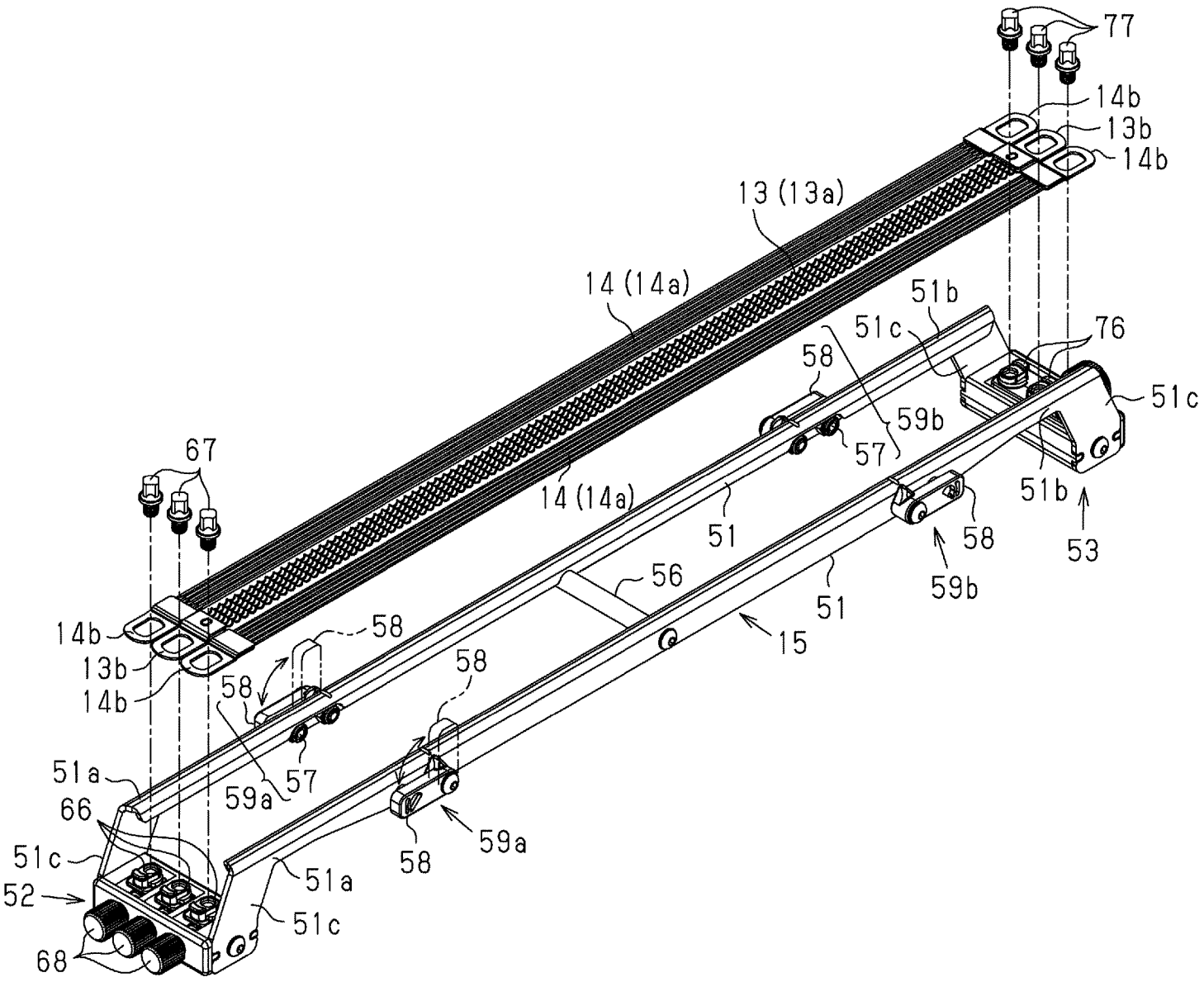
FIG. 5 is a perspective view showing the snare frame and the snare wires.

As shown in FIG. 5, the snare wire 13 is a coil-type snare wire and includes a snare portion 13*a* and a pair of end plates 13*b*. The snare portion 13*a* is configured by multiple coil wires. The end plates 13*b* are each formed like a ring and fixed to the corresponding opposite ends of the snare portion 13*a*. The snare wires 14 are straight-type snare wires and each include a snare portion 14*a* and a pair of end plates 14*b*. Each of the snare portions 14*a* are configured by multiple straight wires. The end plates 14*b* are each formed like a ring and fixed to the corresponding opposite ends of the snare portion 14*a*. The end plates 13*b*, 14*b* may be fixed to the snare portions 13*a*, 14*a* through soldering, welding, or bonding. Each of the snare wires 13, 14 is a full-surface hitting snare wire.

Figure 6:
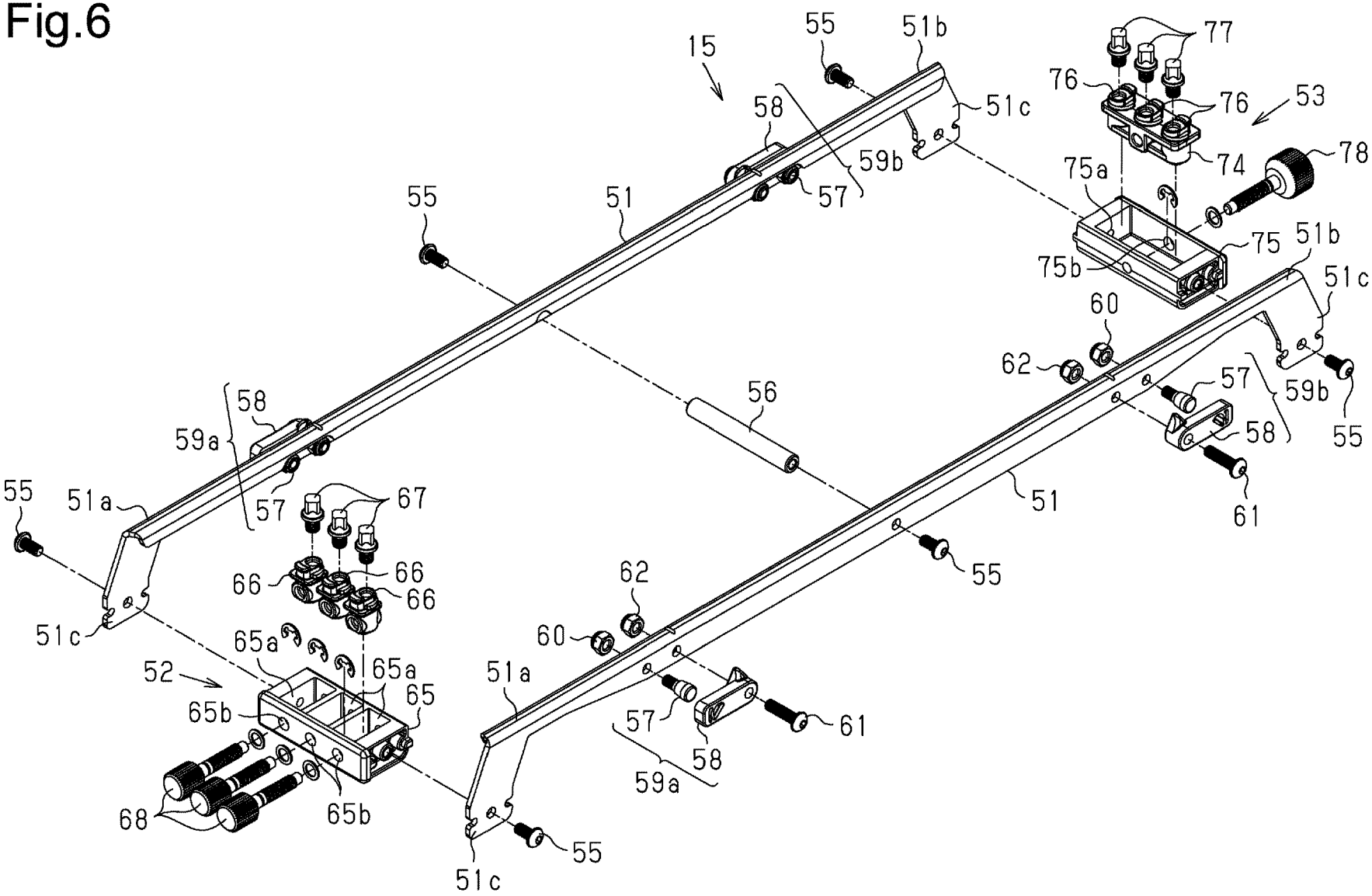
FIG. 6 is an exploded perspective view showing the snare frame.

With reference to FIGS. 5 and 6, the snare frame 15 includes a pair of frame body portions 51, a first frame end section 52, and a second frame end section 53. The frame body portions 51 extend in the longitudinal direction of each snare wire 13, 14. The first and second frame end sections 52, 53 are joined to the corresponding opposite ends of the frame body portions 51. Each of the frame body portions 51 has a length substantially equal to the full length of each snare wire 13, 14. Each frame body portion 51 has a first end section 51*a* and a second end section 51*b*. An attachment piece 51*c* is formed in each of the first and second end sections 51*a*, 51*b*. The opposite frame body portions 51 are joined to the first frame end section 52, the second frame end section 53, and a pipe 56 using multiple screws 55. The first frame end section 52 is disposed between the attachment pieces 51*c* of the first end sections 51*a*. The second frame end section 53 is arranged between the attachment pieces 51*c* of the second end sections 51*b*. The pipe 56 is deployed between the opposite middle sections.

Each frame body portion 51 has hook shafts 57 and stoppers 58 at the positions at which the corresponding strings 16 are hooked. The stoppers 58 are located one by one at an intermediate position between the first end section 51*a* and the middle section of the frame body portion 51 and an intermediate position between the second end section 51*b* and the middle section of the frame body portion 51. The hook shafts 57 are each located at a position closer to the end section of the frame body portion 51 than the corresponding stopper 58. Each hook shaft 57 has a threaded shaft that is inserted through the frame body portion 51. A nut 60 is fastened to the threaded shaft from the inner side, thus fixing the hook shaft 57 to the outer side of the frame body portion 51. Each of the stoppers 58 has a basal end section through which a bolt 61 is inserted. A nut 26 is fastened to the bolt 61 from the inner side, thus fixing the stopper 58 to the outer side of the frame body portion 51 in a pivotable manner.

A first attachment-detachment portion 59*a* is configured by the hook shaft 57 and stopper 58 located in correspondence with the first end section 51*a* of each frame body portion 51. A second attachment-detachment portion 59*b* is configured by the hook shaft 57 and stopper 58 located in correspondence with the second end section 51*b* of the frame body portion 51. The position of the first attachment-detachment portion 59*a* is symmetrical with the position of the second attachment-detachment portion 59*b* with respect to the longitudinal middle of the frame body portion 51. Therefore, the first and second attachment-detachment portions 59*a*, 59*b* are arranged at positions spaced equally from the pipe 56, which is located between the middle sections of the frame body portions 51.

As illustrated in FIGS. 1 and 5, the snare frame 15 is configured such that the strings 16 can be selectively attached to and detached from the corresponding frame body portions 51. For example, as represented by the solid lines in FIGS. 1 and 5, the stoppers 58 may be pivoted until the distal end sections of the stoppers 58 reach the positions coinciding with the corresponding hook shafts 57. In this state, the stoppers 58 stop the corresponding strings 16 in the states hooked to the hook shafts 57. By pivoting the stoppers 58 in this manner, the strings 16 are mounted at the positions corresponding to the first and second end sections 51*a*, 51*b* of the frame body portions 51. In contrast, as represented by the long dashed double-short dashed lines in FIGS. 1 and 5, the stoppers 58 may be pivoted until the distal end sections of the stoppers 58 face upward. This exposes the hook shafts 57 such that the strings 16, which have been hooked to the corresponding hook shafts 57, can be detached from the frame body portions 51.

As shown in FIGS. 5 and 6, the end plates 13*b*, 14*b*, each of which is fixed to the corresponding one of the end sections of the snare wire 13, 14, are fixed to the first frame end section 52. The first frame end section 52 includes an end section body 65 shaped like a rectangular parallelepiped and three end plate fixing portions 66. The end plate 13*b*, 14*b* of each snare wire 13, 14 is fixed to the corresponding end plate fixing portion 66. The first frame end section 52 also includes three screws 67 and three bolts 68. The screws 67 and bolts 68 are each fastened to the corresponding one of the end plate fixing portions 66.

Three accommodation spaces 65*a* are defined in the end section body 65. Each of the accommodation spaces 65*a* accommodates the corresponding one of the end plate fixing portions 66, together with an E-ring. Three communication holes 65*b* are formed in a side wall of the end section body 65 and communicate with the corresponding accommodation spaces 65*a*. The accommodation spaces 65*a* and the communication holes 65*b* are aligned and spaced apart at equal intervals in the longitudinal direction of the end section body 65.

Figure 7:
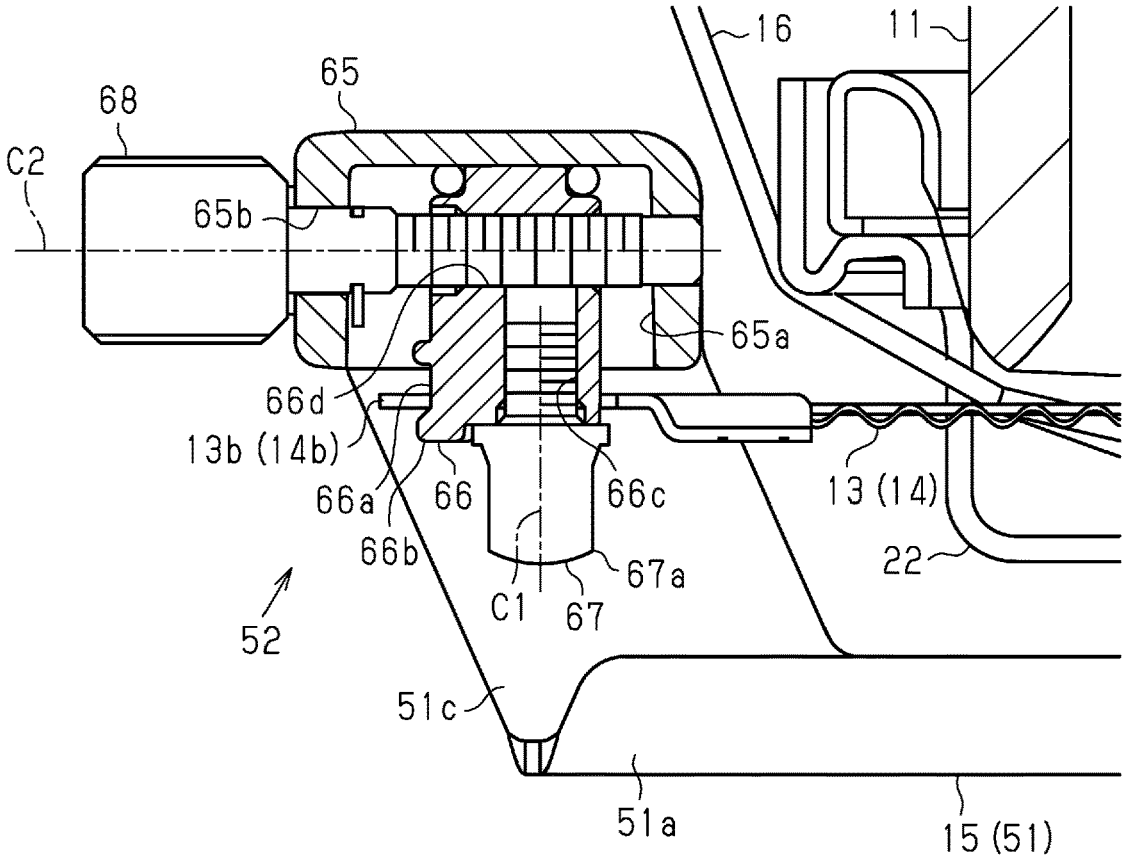
FIG. 7 is a cross-sectional view showing a section of the snare frame in the vicinity of a first frame end section as viewed from a side.
Figure 8:
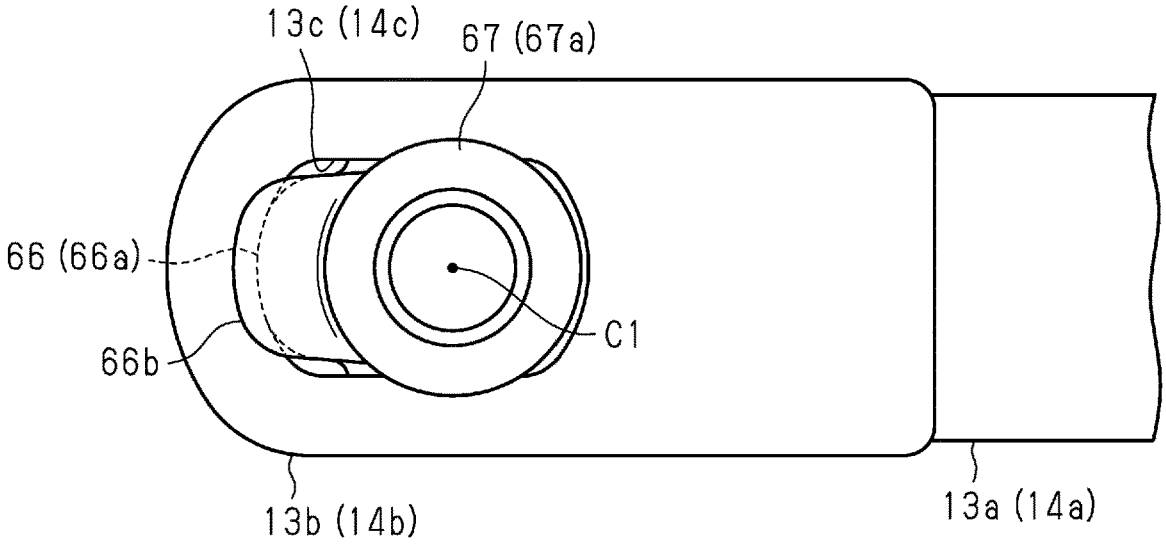
FIG. 8 is a plan view showing a section of the snare frame in the vicinity of the first frame end section as viewed from below.

With reference to FIGS. 7 and 8, each of the end plate fixing portions 66 includes a hook portion 66*a* and a flange 66*b*. The end plate 13*b*, 14*b* of each of the snare wires 13, 14 is hooked to the corresponding one of the hook portions 66*a*. Each of the flanges 66*b* is located below the corresponding one of the hook portions 66*a*. Each flange 66*b* projects from the lower end section of the end plate fixing portion 66 outward in the longitudinal direction of the frame body portion 51. The end plate fixing portion 66 also has a threaded hole 66*c* and a bolt hole 66*d*. The threaded hole 66*c* has axis C1 perpendicular to the projecting direction of the flange 66*b*. The bolt hole 66*d* extends perpendicularly to the threaded hole 66*c*.

The end plate 13*b* and the end plate 14*b* have a through hole 13*c* and a through hole 14*c*, respectively. When the end plate 13*b*, 14*b* is hooked to the hook portion 66*a*, the flange 66*b* passes through the through hole 13*c*, 14*c*. The diameter of a head portion 67*a* of each screw 67, which is fastened to the corresponding threaded hole 66*c*, is greater than the width of the through hole 13*c*, 14*c*. Therefore, the head portion 67*a* of the screw 67, which is fastened to the threaded hole 66*c*, stops separation of the end plate 13*b*, 14*b* of the snare wire 13, 14 from the hook portion 66*a* of the end plate fixing portion 66.

In the state in which the snare wires 13, 14 are attached to the snare drum 10 by means of the snare frame 15, each of the end plate fixing portions 66 is disposed in the corresponding one of the accommodation spaces 65*a* of the end section body 65 with the threaded hole 66*c* facing downward and the bolt hole 66*d* facing outward. In this state, the bolt 68 is fastened to the bolt hole 66*d* of the end plate fixing portion 66 through the communication hole 65*b* from the outer side of the end section body 65. By changing the amount by which the bolt 68 is fastened to the bolt hole 66*d*, each end plate fixing portion 66 is allowed to slide in the corresponding accommodation space 65*a* along axis C2 of the bolt 68. That is, by manipulating the respective bolts 68 separately from one another, the corresponding end plate fixing portions 66 are allowed to slide independently of one another in the first frame end section 52.

As shown in FIGS. 5 and 6, the end plates 13*b*, 14*b*, each of which is fixed to the other one of the end sections of the snare wire 13, 14, are fixed to the second frame end section 53. The second frame end section 53 includes an end section body 75 shaped like a rectangular parallelepiped and a slider 74. Three end plate fixing portions 76 are formed integrally with the slider 74. The end plates 13*b*, 14*b* of the snare wires 13, 14 are fixed to the corresponding end plate fixing portions 76. The second frame end section 53 also includes three screws 77 and a bolt 78. The screws 77 are fastened to the corresponding end plate fixing portions 76 and the bolt 78 is fastened to the slider 74. An accommodation space 75*a* is defined in the end section body 75 and accommodates the slider 74, together with an E-ring. A communication hole 75*b* is formed in a side wall of the end section body 75 and communicates with the accommodation space 75*a*.

Figure 9:
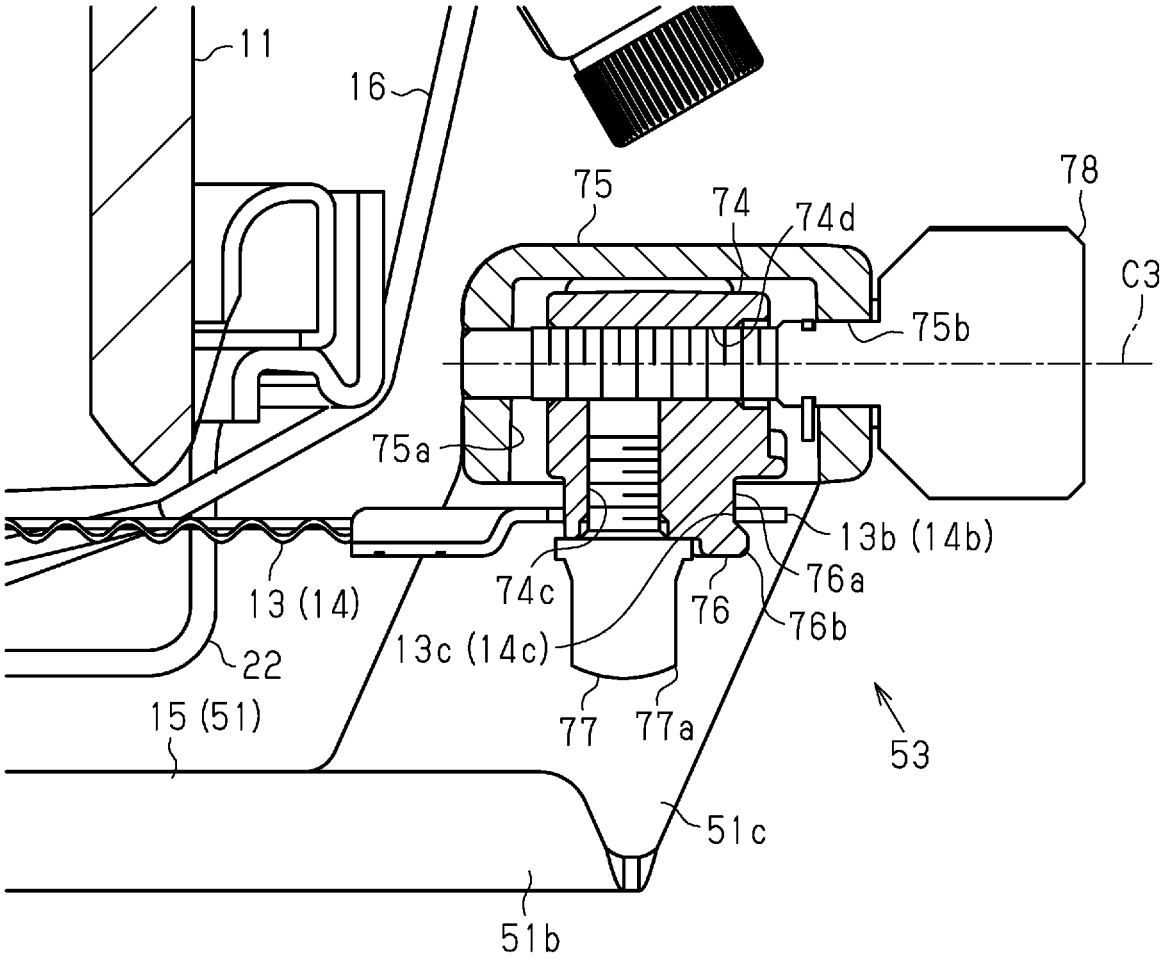
FIG. 9 is a cross-sectional view showing a section of the snare frame in the vicinity of a second frame end section as viewed from a side.

As illustrated in FIG. 9, each of the end plate fixing portions 76 of the second frame end section 53 includes a hook portion 76*a* and a flange 76*b*, like the end plate fixing portions 66 of the first frame end section 52. The hook portions 76*a* and flanges 76*b* of the second frame end section 53 are identical with the hook portions 66*a* and flanges 66*b* of the first frame end section 52. Therefore, description of the hook portions 76*a* and flanges 76*b* is omitted herein.

In the state in which the snare wires 13, 14 are attached to the snare drum 10 by means of the snare frame 15, the slider 74 is disposed in the accommodation space 75*a* of the end section body 75 with threaded holes 74*c* facing downward and a bolt hole 74*d* facing outward. The bolt 78 is fastened to the bolt hole 74*d* of the slider 74 through the communication hole 75*b* from the outer side of the end section body 75. By changing the amount by which the bolt 78 is fastened to the bolt hole 74*d*, the slider 74 is allowed to slide in the accommodation space 75*a* along axis C3 of the bolt 78. That is, by manipulating the bolt 78, the end plate fixing portions 76 are allowed to slide integrally in the second frame end section 53.

As shown in FIGS. 5 and 6, the first and second frame end sections 52, 53 are joined to the frame body portions 51 and, in this state, the end plate fixing portions 66 of the first frame end section 52 are each arranged in a manner forming a pair with the corresponding one of the end plate fixing portions 76 of the second frame end section 53. In the present embodiment, the snare wire 13 is fixed to the first and second frame end sections 52, 53 such that the snare wire 13 extends on the axis of the snare frame 15. The two snare wires 14 are fixed to the first and second frame end sections 52, 53 such that the snare wires 14 are disposed on the opposite sides of the snare wire 13 along the axis of the snare frame 15.

With reference to FIGS. 1 to 3, the snare frame 15, with the snare wires 13, 14 fixed to the snare frame 15, is attached to the lower opening end of the shell 11 through the strings 16. In this state, the end plates 13*b*, 14*b* of the snare wires 13, 14 are exposed outward with respect to the outer peripheral edge of the back-surface head 12*b*. Also in this state, only the snare portions 13*a*, 14*a* of the snare wires 13, 14 contact the back-surface head 12*b*. The snare wires 13, 14 are attached to the lower opening end of the shell 11 with each of the snare portions 13*a*, 14*a*, substantially as a whole, held in touch with the back-surface head 12*b*.

In the snare frame 15, the first and second frame end sections 52, 53 are arranged outward with respect to the outer peripheral edge of the back-surface head 12*b* in the radial direction of the shell 11. The first frame end section 52 is arranged below the holder 17*a* of the strainer 17. As viewed in the axial direction of the shell 11, the first frame end section 52 is disposed at the position coinciding with the holder 17*a*. The second frame end section 53 is arranged below the holder 18*a* of the holding tool 18. As viewed in the axial direction of the shell 11, the second frame end section 53 is disposed at the position coinciding with the holder 18*a*.

The strings 16 are each coupled to the snare frame 15 by means of the corresponding hook shaft 57 and stopper 58 at a position inward with respect to the outer peripheral edge of the back-surface head 12*b*. Specifically, in the vicinities of the first end sections 51*a* of the frame body portions 51, the first attachment-detachment portions 59*a* couple the corresponding strings 16 to the snare frame 15 at the positions intermediate between the first end sections 51*a* and the middle sections of the frame body portions 51. In the vicinities of the second end sections 51*b* of the frame body portions 51, the second attachment-detachment portions 59*b* couple the corresponding strings 16 to the snare frame 15 at the positions intermediate between the second end sections 51*b* and the middle sections of the frame body portions 51. Each of the strings 16 is bent by the outer peripheral edge of the back-surface head 12*b* and the outer frame of the lower hoop 22 and, in this state, couples the snare frame 15 to the snare drum 10.

Next, the operation of the attachment structure of the snare wires 13, 14, as well as the attachment procedure of the snare wires 13, 14, will be described with reference to FIGS. 1 to 3. The attachment procedure of the snare wires 13, 14 will first be described.

To attach the snare wires 13, 14 to the snare drum 10 using the snare frame 15, as illustrated in FIGS. 1 to 3, the snare frame 15 is first coupled to the holders 17*a*, 18*a* of the strainer 17 and the holding tool 18 using the four strings 16. Subsequently, by pivoting the lever 17*b* of the strainer 17, the two of the strings 16 coupled to the holder 17*a* of the strainer 17 raise the snare frame 15 from the standby position represented by the long dashed double-short dashed lines in FIGS. 2 and 3 to the use position represented by the solid lines in the drawings. This switches the position of each of the snare wires 13, 14 from OFF position to ON position. Each snare wire 13, 14 is spaced from the back-surface head 12*b* when at OFF position and contacts the back-surface head 12*b* when at ON position.

After switching the position of each snare wire 13, 14 from OFF position to ON position, the effective lengths of the strings 16 are changed at the side corresponding to the corresponding holders 17*a*, 18*a* to adjust the position of the snare frame 15 in the up-down direction. The effective length of each string 16 represents such a length of the string 16 that the string 16 functions as a coupling member in the state mounted on the holder 17*a* and the first attachment-detachment portion 59*a* or the holder 18*a* and the second attachment-detachment portion 59*b*. In other words, the effective length of the string 16 represents the apparent length of the string 16 that couples the holder 17*a* to the first attachment-detachment portion 59*a* or the holder 18*a* to the second attachment-detachment portion 59*b* when the snare wires 13, 14 are located at ON positions.

After switching the positions of the snare wires 13, 14 to ON positions, the manipulating portions 17*c*, 18*c* are manipulated to change the positions of the holders 17*a*, 18*a* in the up-down direction such that the position of the snare frame 15 is further adjusted in the up-down direction. In this manner, with the snare wires 13, 14 arranged at ON positions, by adjusting the effective lengths of the respective strings 16 or changing the positions of the respective holders 17*a*, 18*a*, the state of contact between the snare portion 13*a*, 14*a* of each snare wire 13, 14 and the back-surface head 12*b* is precisely adjusted.

To detach the snare frame 15 from the snare drum 10, all of the stoppers 58 are pivoted until the distal end sections of the stoppers 58 face upward, as represented by the long dashed double-short dashed lines in FIG. 1. Then, the strings 16, which have been hooked to the corresponding hook shafts 57, are detached from the hook shafts 57. Subsequently, with the strings 16 held by the corresponding holders 17*a*, 18*a*, the snare frame 15 is detached from the snare drum 10. At this stage, the strings 16 remain coupled to the holders 17*a*, 18*a* while maintaining their adjusted lengths.

The operation of the attachment structure of the snare wires 13, 14 will hereafter be described.

The strings 16, which are used to couple the snare frame 15 to the snare drum 10, are made of flexible material. The strings 16 thus provide flexibility to the portions that couple the snare frame 15 to the holders 17*a*, 18*a*. This configuration does not hamper the vibration of the snare frame 15, unlike the configuration using link components made of metal as coupling members. As a result, the vibration of each of the snare wires 13, 14 is not hampered and resonance of the vibration sound of each snare wire 13, 14 is allowed.

The first and second frame end sections 52, 53 are both arranged outward with respect to the outer peripheral edge of the back-surface head 12*b* in the radial direction of the shell 11. Such arrangement causes only the snare portions 13*a*, 14*a* of the snare wires 13, 14 to contact the back-surface head 12*b*. This makes it unlikely that the end plates 13*b*, 14*b* of the snare wires 13, 14 will bite into the surface of the back-surface head 12*b* even when the strings 16 are pulled intensely to increase the amounts by which the snare portions 13*a*, 14*a* contact the back-surface head 12*b*. The end plates 13*b*, 14*b* thus do not hamper the vibration of the back-surface head 12*b*, allowing resonance of the vibration sound of the striking-surface head 12*a* and the vibration sound of the back-surface head 12*b*. This improves resonance of the characteristic sound of the snare drum 10.

The present embodiment has the advantages described below.

(1) Each of the string 16 serving as a coupling member is made of flexible material and does not hamper the vibration of the snare frame 15. The vibration of each snare wire 13, 14 is thus not hampered, which allows resonance of the vibration sounds of the snare wires 13, 14. Also, since the first and second frame end sections 52, 53 are each disposed outward with respect to the outer peripheral edge of the back-surface head 12*b*, the end plates 13*b*, 14*b* of the snare wires 13, 14 are unlikely to bite into the surface of the back-surface head 12*b*. The end plates 13*b* 14*b* thus do not hamper the vibration of the back-surface head 12*b*, which allows resonance of the vibration sound of the striking-surface head 12*a* and that of the back-surface head 12*b*.

(2) The first frame end section 52 is disposed below the holder 17*a* of the strainer 17 at the position coinciding with the holder 17*a* as viewed in the axial direction of the shell 11. The second frame end section 53 is arranged below the holder 18*a* of the holding tool 18 at the position coinciding with the holder 18*a* as viewed in the axial direction of the shell 11. In this configuration, the first and second frame end sections 52, 53 are disposed immediately below the corresponding holders 17*a*, 18*a*. Each of the first and second frame end sections 52, 53 is thus spaced outward from the outer peripheral edge of the back-surface head 12*b*. This allows the readily vibrating portions of the snare portions 13*a*, 14*a* to contact the surface of the back-surface head 12*b*. The snare wires 13, 14 are thus allowed to vibrate effectively, thus further improving resonance of the vibration sounds of the snare wires 13, 14. Also, in this configuration, the snare frame 15 projects outward only to a limited extent in the radial direction of the shell 11 and thus does not obstruct the playing by the player when the player plays the snare drum 10.

(3) The strings 16 are coupled to the snare frame 15 by the corresponding hook shafts 57 and stoppers 58 at the positions inward with respect to the outer peripheral edge of the back-surface head 12*b*. In this configuration, the strings 16 are bent by the outer peripheral edge of the back-surface head 12*b* and, in this state, couple the snare frame 15 to the snare drum 10. As a result, the snare frame 15 is coupled to the snare drum 10 with a certain level of tensile force acting on the strings 16. Therefore, even if the snare drum 10 is played with the striking-surface head 12*a* inclined, the contact between the snare portion 13*a*, 14*a* of each snare wire 13, 14 and the back-surface head 12*b* is maintained in a desirable state. This further improves resonance of the vibration sounds of the snare wires 13, 14.

In the present embodiment, the four strings 16 are employed to couple the snare frame 15 to the snare drum 10. The snare frame 15 is configured such that the effective lengths of the strings 16, which correspond to the four corners of the snare frame 15, are adjustable independently. In this case, by changing the effective lengths of the respective strings 16, the state of contact between the snare portion 13*a*, 14*a* of each snare wire 13, 14 and the back-surface head 12*b* is adjusted precisely. This facilitates uniform contact between the snare portions 13*a*, 14*a* of the snare wires 13, 14 and the back-surface head 12*b*, regardless of the angle at which the snare drum 10 is installed.

(4) Each string 16 is selectively attached to and detached from either the corresponding the holder 17*a*, 18*a* of the strainer 17 or the holding tool 18 or the corresponding first or second attachment-detachment portion 59*a*, 59*b* of the snare frame 15. In this configuration, simply by detaching the strings 16 from either the snare frame 15 or the snare drum 10, the snare frame 15 is detached from the snare drum 10. In this case, the snare frame 15 is detached from the snare drum 10 with the snare wires 13, 14 fixed to the snare frame 15, without changing the tensile force of each snare wire 13, 14.

If the effective lengths of the strings 16 are adjusted to ensure uniform contact between the snare portions 13*a*, 14*a* and the back-surface head 12*b*, the snare frame 15 can be detached from the snare drum 10 with the strings 16 remaining attached to either the snare frame 15 or the snare drum 10, without changing the adjusted effective lengths of the strings 16. Therefore, in this configuration, the tensile force of each snare wire 13, 14 and the effective length of each string 16 are maintained in the adjusted states even after the snare drum 10 is detached from the snare frame 15. This facilitates reproduction of the sound of the snare drum 10 that has been produced by the most recent play.

The strings 16 are each attachable-detachable from the snare frame 15 and the snare drum 10. Therefore, unlike the conventional configurations, it is unnecessary to pull or loosen each snare wire by means of the corresponding string every time the snare wire is detached. The snare frame 15 is thus easily detached from the snare drum 10. This facilitates replacement of each drum head and decreases the load on the snare portion 13*a*, 14*a* of each snare wire 13, 14.

(5) The position of the first attachment-detachment portion 59*a* is symmetrical with the position of the second attachment-detachment portion 59*b* about the longitudinal middle of each frame body portion 51. In this configuration, the snare wires 13, 14 may be detached from the snare drum 10 and then the snare frame 15 may be attached to the snare drum 10 with the posture of the snare frame 15 reversed with respect to its posture before detachment from the snare drum 10. This allows reproduction of the sound of the snare drum 10 that has been produced by the most recent play.

(6) The end plate fixing portions 66 of the first frame end section 52 are arranged such that each end plate fixing portion 66 forms a pair with the corresponding end plate fixing portion 76 of the second frame end section 53. This allows attachment of different types of snare wires 13, 14, such as straight wires and coil wires, to the snare frame 15. Using the different types of snare wires 13, 14, resonance of the characteristic sound of the snare drum 10 is further improved.

(7) The end plate fixing portions 66 are slidable in the first frame end section 52 independently of one another. In this configuration, the tensile force of each snare wire 13, 14 is adjusted separately by manipulating the corresponding one of the three bolts 68 separately. Also, the amount by which the snare portion 13*a*, 14*a* of each snare wire 13, 14 contacts the back-surface head 12*b* is adjusted precisely.

The end plate fixing portions 76 are slidable integrally in the second frame end section 53. This configuration allows the simultaneous pulling and loosening of the snare wires 13, 14, thus facilitating the applying and releasing of tensile force with respect to the snare wires 13, 14. The attachment-detachment of the snare wires 13, 14 with respect to the snare frame 15 is thus facilitated.

(8) Each end plate fixing portion 66 of the first frame end section 52 has the hook portion 66*a* and the flange 66*b*. The end plate 13*b*, 14*b* of each snare wire 13, 14 is hooked to the corresponding hook portion 66*a*. The flanges 66*b* are located below the corresponding hook portions 66*a*. The end plate fixing portions 76 of the second frame end section 53 are configured identically with the end plate fixing portions 66 of the first frame end section 52. In this configuration, when the end plates 13*b*, 14*b* of the snare wires 13, 14 are hooked to the corresponding end plate fixing portions 66, 76, the end plates 13*b*, 14*b* are supported from below by the flanges 66*b*, 76*b* of the end plate fixing portions 66, 76. As a result, when a certain level of tensile force acts on the snare wires 13, 14, the opposite ends of each snare wire 13, 14 are supported by the snare frame 15 such that the snare wire 13, 14 does not separate from the snare frame 15. This makes it unnecessary to fix the end plates 13*b*, 14*b* of the snare wires 13, 14 to the snare frame 15 using screws every time the snare wires 13, 14 are replaced when the snare drum 10 is tuned.

If, for example, the tensile force of each snare wire 13, 14 is adjusted while the snare drum 10 is being played, there may be a case in which the snare wire 13, 14 is released from the tensile force. Even in this case, the end plates 13*b*, 14*b* of the snare wires 13, 14 are supported from below by the head portions 67*a*, 77*a* of the corresponding screws 67, 77, which are fastened to the threaded holes 66*c*, 74*c* of the end plate fixing portions 66, 76. The snare wires 13, 14 are thus stopped from separating from the snare frame 15 even after the snare wires 13, 14 are released from the tensile force.

Also, in this configuration, the end plates 13*b*, 14*b* are held pivotably without being fixed to the end plate fixing portions 66, 67 using the screws 67, 77. Each end plate 13*b*, 14*b* is thus allowed to pivot at the corresponding one of the opposite ends of the snare portion 13*a*, 14*a* and move to such a position that uniform tensile force acts on the snare portion 13*a*, 14*a* of the snare wire 13, 14.

(9) Four of the second tension bolts 25 are disposed in the vicinities of the opposite end sections of the snare frame 15 and the leg supports 28 are each mounted on the corresponding one of the four second tension bolts 25. In this configuration, when the snare wires 13, 14 are attached to the snare drum 10 using the snare frame 15 and the snare drum 10 is placed on the floor surface, the leg supports 28 maintain the snare frame 15 higher than the floor surface such that the snare frame 15 is in a load-free state.

The present embodiment may be modified in the forms described below.

Although the strings 16 are employed as the coupling members in the present embodiment, the coupling members may be belts. Also in this case, the belts are made of flexible high-strength plastic such as nylon.

In the present embodiment, the first frame end section 52 may be arranged below the holder 17*a* of the strainer 17 at a position between the outer peripheral edge of the back-surface head 12*b* and the holder 17*a*. Similarly, the second frame end section 53 may be arranged below the holder 18*a* of the holding tool 18 at a position between the outer peripheral edge of the back-surface head 12*b* and the holder 18*a*.

In the present embodiment, the end sections of the snare frame 15 may be coupled to the holder 17*a* of the strainer 17 and the holder 18*a* of the holding tool 18 using the strings 16, each at a position outward with respect to the outer peripheral edge of the back-surface head 12*b*.

In the present embodiment, the snare frame 15 is detached from the snare drum 10 by detaching the strings 16 from the first and second attachment-detachment portions 59*a*, 59*b* with the strings 16 held by the corresponding holders 17*a*, 18*a*. That is, the effective lengths of the respective strings 16 are adjusted at the sides corresponding to the holders 17*a*, 18*a* and the strings 16 are detached from the snare frame 15 without changing the adjusted effective lengths of the strings 16. However, the embodiment is not restricted to this. For example, the snare frame 15 may be detached from the snare drum 10 by detaching the strings 16 from the holders 17*a*, 18*a* with the strings 16 attached to the snare frame 15. In this case, the effective lengths of the respective strings 16 are adjusted at the side corresponding to the snare frame 15 and the strings 16 are detached from the holders 17*a*, 18*a* without changing the adjusted effective lengths of the strings 16.

In the present embodiment, the four strings 16 are used to couple the snare frame 15 to the snare drum 10 and the effective lengths of the strings 16 are separately adjustable. However, the embodiment is not restricted to this. For example, two strings 16 may be fixed to the opposite ends of the snare frame 15 and the effective lengths of the strings 16 may be adjusted separately. That is, any number of strings 16 may be employed as long as the effective lengths of the strings 16 are adjustable independently for each of the four corners of the snare frame 15.

In the present embodiment, the same type of snare wires may be attached to the snare frame 15 or, alternatively, one or more snare wires may be attached to the snare frame 15. If two or more snare wires are attached to the snare frame 15, the snare wires may all be different types of snare wires from one another.

In the present embodiment, the configuration for allowing the end plate fixing portions 66 to be slidable may be omitted from the first frame end section 52. Also, the configuration for allowing the slider 74 to be slidable may be omitted from the second frame end section 53.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A snare wire attachment structure for attaching a snare wire to a snare drum using a snare frame, wherein the snare drum includes a cylindrical shell, a pair of drum heads, wherein the drum heads are mounted on upper and lower opening ends of the shell, and a coupling member that couples the snare frame to the snare drum, the snare wire includes a snare portion configured by a plurality of wires, and a pair of end plates, wherein the end plates are located on opposite ends of the snare portion, the snare frame includes a frame body portion that extends in a longitudinal direction of the snare wire, and a pair of frame end sections, wherein the frame end sections are located on opposite ends of the frame body portion and the end plates of the snare wire are fixed to the corresponding frame end sections, the coupling member is made of flexible material, and in a state in which the snare wire is attached to the snare drum by means of the snare frame, the two frame end sections are each disposed outward with respect to the outer peripheral edge of the corresponding one of the drum heads.

2. The snare wire attachment structure according to claim 1, wherein the snare drum further includes holders, wherein the holders are located on an outer peripheral surface of the shell and the coupling member is one of coupling members coupled to the corresponding holders, and the frame end sections are each arranged at a position that is below the corresponding one of the holders and coincides with the holder as viewed in the axial direction of the shell.

3. The snare wire attachment structure according to claim 1, wherein the coupling member is coupled to the snare frame at a position inward with respect to an outer peripheral edge of the corresponding drum head.

4. The snare wire attachment structure according to claim 1, wherein the coupling member can be selectively attached to and detached from either the snare frame or the snare drum without changing an effective length of the coupling member.

5. The snare wire attachment structure according to claim 4, wherein the snare frame has an attachment-detachment portion in the frame body portion, wherein the coupling member is selectively attached to and detached from the attachment-detachment portion, the attachment-detachment portion is one of attachment-detachment portions located in correspondence with a first end section and a second end section of the frame body portion, and the position of the attachment-detachment portion corresponding to the first end section as a first attachment-detachment portion is symmetrical with the position of the attachment-detachment portion corresponding to the second end section as a second attachment-detachment portion about a longitudinal middle of the frame body portion.

6. The snare wire attachment structure according to claim 1, wherein the frame end sections each include a plurality of end plate fixing portions, wherein the end plates of the snare wire are fixed to the corresponding end plate fixing portions, and the end plate fixing portions located in a first frame end section as one of the frame end sections are each arranged in a manner forming a pair with the corresponding one of the end plate fixing portions of a second frame end section as the other frame end section.

7. The snare wire attachment structure according to claim 6, wherein the end plate fixing portions are formed in the first frame end section in a slidable manner independently of one another, and the end plate fixing portions are formed in the second frame end section in an integrally slidable manner.

8. The snare wire attachment structure according to claim 7, wherein each of the end plate fixing portions includes a hook portion to which the corresponding end plate is hooked, a flange that is located below the hooked portion and projects outward in a longitudinal direction of the frame body portion, and a threaded hole that has an axis perpendicular to the direction in which the flange projects, and each end plate fixing portion is configured to stop separation of the corresponding end plate hooked to the hook portion by means of a head portion of a thread fastened to the threaded hole.

9. The snare wire attachment structure according to claim 1, wherein the snare drum further includes a plurality of lugs formed on the outer peripheral surface of the shell, a plurality of tension bolts, wherein the tension bolts are fastened to corresponding threaded holes in the lugs, and a plurality of leg supports, wherein the leg supports are mounted on the corresponding tension bolts and each function as a leg portion of the snare drum, and in the state in which the snare wire is attached to the snare drum by means of the snare frame, a lower end of each of the leg supports projects downward with respect to a lower edge of the frame body portion.

10. A snare drum comprising:

a cylindrical shell;

a pair of drum heads, wherein the drum heads are mounted on upper and lower opening ends of the shell;

a snare wire attached to the shell in a manner contacting the one of the drum heads mounted on the lower opening end of the shell;

a snare frame used to attach the snare wire to the shell; and a coupling member that couples the snare frame to the shell, wherein the snare wire includes a snare portion configured by a plurality of wires and a pair of end plates, wherein the end plates are located on opposite ends of the snare portion, the snare frame includes a frame body portion that extends in a longitudinal direction of the snare wire and a pair of frame end sections, wherein the frame end sections are located on opposite ends of the frame body portion and each of the end plates of the snare wire is fixed to the corresponding one of the frame end sections, the coupling member is made of flexible material, and in a state in which the snare wire is attached to the shell by means of the snare frame, the frame end sections are each arranged outward with respect to an outer peripheral edge of the corresponding one of the drum heads.

* * * * *